US012458081B2

(12) United States Patent
Batista Mendes et al.

(10) Patent No.: US 12,458,081 B2
(45) Date of Patent: Nov. 4, 2025

(54) DEVICE FOR PROTECTING AT LEAST ONE PART OF THE FACE

(71) Applicant: SIMON ET CIE, Avallon (FR)

(72) Inventors: Carlos Batista Mendes, Annay la Cote (FR); Jean-Baptiste Duban, Athie (FR); Christophe Bertrand, Mellecey (FR)

(73) Assignee: SIMON ET CIE, Avallon (FR)

( * ) Notice: Subject to any disclaimer, the term of this patent is extended or adjusted under 35 U.S.C. 154(b) by 359 days.

(21) Appl. No.: 17/911,821

(22) PCT Filed: Mar. 19, 2021

(86) PCT No.: PCT/EP2021/057128
§ 371 (c)(1),
(2) Date: Sep. 15, 2022

(87) PCT Pub. No.: WO2021/191084
PCT Pub. Date: Sep. 30, 2021

(65) Prior Publication Data

US 2023/0138060 A1 May 4, 2023

(30) Foreign Application Priority Data

Mar. 21, 2020 (FR) ..... FR2002774
Apr. 22, 2020 (FR) ..... 2004012

(51) Int. Cl.
*A41D 13/11* (2006.01)

(52) U.S. Cl.
CPC ..... *A41D 13/1107* (2013.01); *A41D 13/1161* (2013.01)

(58) Field of Classification Search
CPC ..... A41D 13/1107; A41D 13/1161; A41D 13/1184; A41D 31/10; A41D 13/11;
(Continued)

(56) References Cited

U.S. PATENT DOCUMENTS 2,038,310 A * 4/1936 Panettiere ..... A41D 13/11 128/858
4,856,535 A * 8/1989 Forbes ..... A41D 13/1184 2/9

(Continued)

FOREIGN PATENT DOCUMENTS

AU 2002341981 A1 * 9/2003 ..... A41D 13/1176
CA 2184638 A1 * 5/1997

(Continued)

OTHER PUBLICATIONS

International Search Report mailed on May 14, 2021, in corresponding International Application No. PCT/EP2021/057128; 7 pages (with English Translation).

(Continued)

*Primary Examiner* — Tarla R Patel
(74) *Attorney, Agent, or Firm* — Maier & Maier, PLLC

(57) ABSTRACT

A device for protecting at least one part of the face of a user to prevent the spread of projections from the respiratory tract. A single flexible sheet, made of a material impermeable to the spread of these projections, and defining a substantially rectangular or square strip and at least two first straps each coming from one of the ends of the upper edge of the strip, the strip of the sheet being shaped to cover at least the nose and the mouth of the user, the upper edge of the strip resting on the top of the nose or on the forehead, the two first straps being arranged to be tied together at the back of the user's head, passing over their ears.

7 Claims, 3 Drawing Sheets

(58) Field of Classification Search
CPC ..... A62B 18/00; A62B 18/02; A62B 18/084; A61M 16/06; A61M 16/0605; A61M 16/0633
See application file for complete search history.

(56) References Cited

U.S. PATENT DOCUMENTS

| | | | | |
|---|---|---|---|---|
| 5,590,646 | A * | 1/1997 | Murphy | A62B 23/025 128/206.28 |
| 6,694,971 | B2 * | 2/2004 | Schroeder | A62B 23/025 128/201.14 |
| 10,806,235 | B1 * | 10/2020 | Bernstein | A41D 13/1184 |
| 2004/0121107 | A1 | 6/2004 | Bell et al. | |
| 2005/0155606 | A1 * | 7/2005 | Collins | A41D 13/11 128/206.29 |

FOREIGN PATENT DOCUMENTS

| | | | | |
|---|---|---|---|---|
| CA | 2552232 | A1 * | 1/2008 | A61F 9/029 |
| CA | 3065616 | A1 * | 6/2021 | A41D 13/1184 |
| DE | 3800959 | C1 | 12/1988 | |
| EP | 2989914 | A1 * | 3/2016 | A41D 13/1107 |
| FR | 2182700 | A1 | 12/1973 | |
| JP | 3097085 | U * | 1/2004 | |
| KR | 100940332 | B1 * | 2/2010 | |
| KR | 20180061724 | A * | 6/2018 | |
| KR | 102236062 | B1 * | 8/2020 | |
| WO | WO-2008085014 | A1 * | 7/2008 | A41D 13/1161 |

OTHER PUBLICATIONS

Written Opinion of the International Searching Authority mailed May 14, 2021, in corresponding International Application No. PCT/EP2021/057128; 13 pages (with English Translation).

* cited by examiner

[Fig. 1]
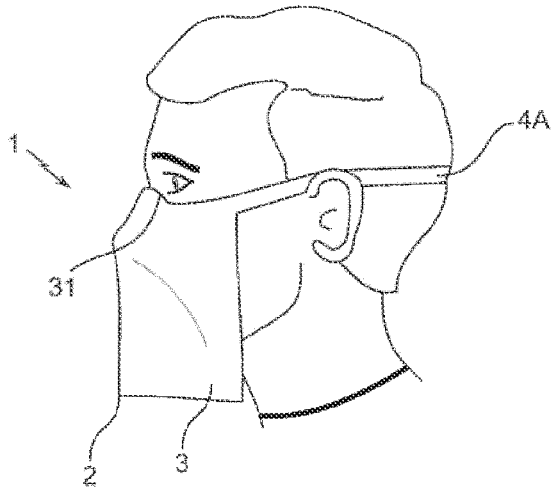
[Fig. 2]
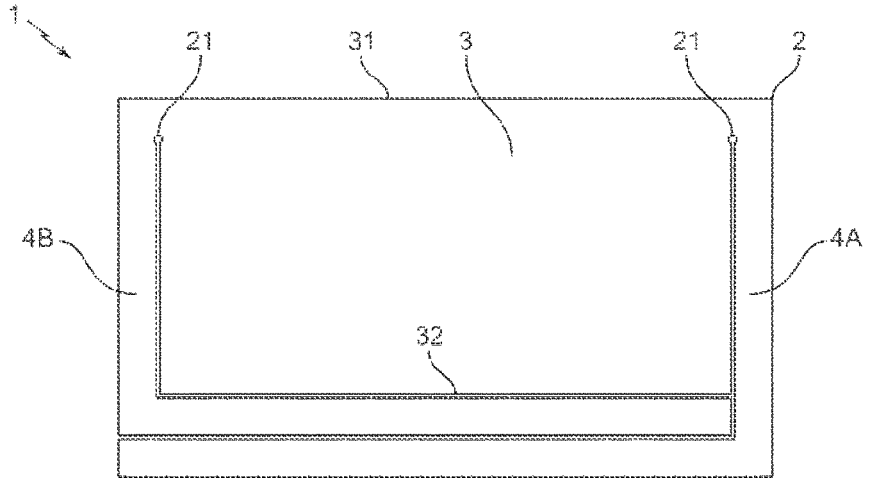

[Fig. 3]
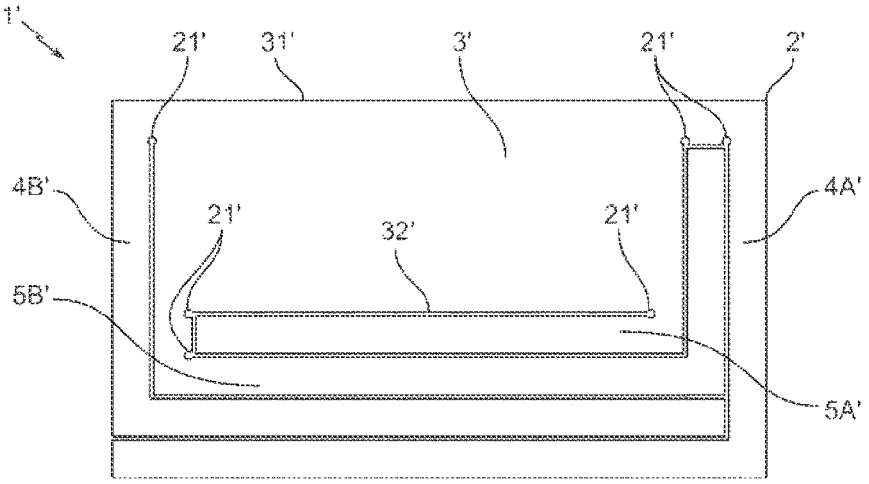
[Fig. 4]
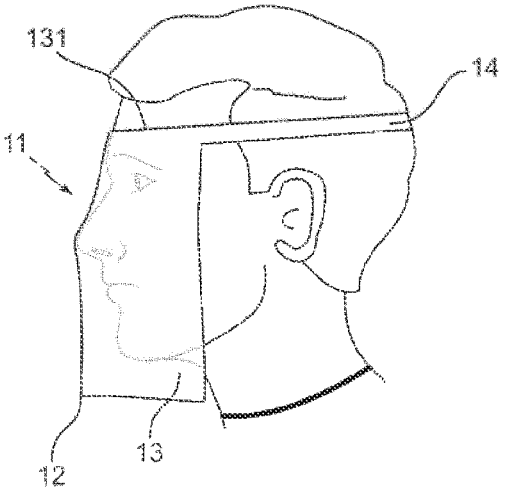

[Fig. 5]
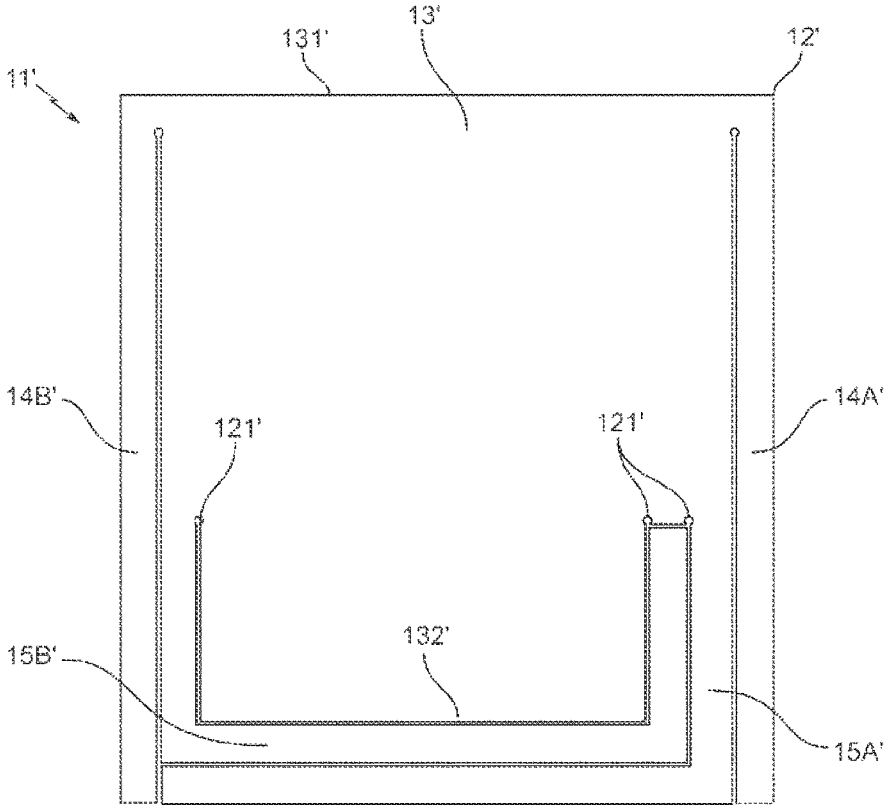

DEVICE FOR PROTECTING AT LEAST ONE PART OF THE FACE

TECHNICAL FIELD OF THE INVENTION

The present invention relates to the general field of the protection of human beings. It is aimed more precisely at a device for protecting the respiratory tract and at least one part of the face.

PRIOR ART

In the medical domain, the caregivers use devices for protecting their respiratory tracts and at least one part of the face against contaminating projections coming from the sick and containing germs, bacteria or viruses.

These known protective devices are, conventionally, surgical masks made of paper or fabrics including one or more layers and being maintained on the face of the wearer by cords passing around the ears or tied around the head, or face shields.

For reasons of ease of use, these masks are generally disposable and non-reusable. However, in the case of a shortage in particular during a pandemic, staff are tempted to reuse their masks, which represents a significant risk of transmission of infectious diseases. Moreover, some of these "disposable" masks are difficult to recycle.

Furthermore, these masks, which are certainly effective, have the disadvantage of not being impermeable and of requiring manufacturing in several operations, which extends the manufacturing time and significantly increases the unit cost of each mask.

SUMMARY OF THE INVENTION

The goal of the present invention is therefore to propose a device for protecting the respiratory tract and at least one part of the face of an individual against projections intended in particular for caregivers, said device being effective, easy to implement and to recycle, and not very costly, its manufacturing only requiring a single operation.

According to the invention, a device is therefore proposed for protecting the respiratory tract and at least one part of the face of a user against projections remarkable in that it comprises a single flexible sheet, made of a material impermeable to said projections, and defining a strip having the overall shape of a rectangle or a square and at least two first straps each coming from one of the ends of the upper edge of said strip, the strip of the sheet being shaped to cover at least the nose and the mouth of the user, the upper edge of said strip resting on the top of the nose or on the forehead, the two first straps being arranged to be tied together at the back of the head of the user while passing above the ears of the latter.

The sheet is advantageously made of a transparent material.

The strip is shaped to be transparent at least in front of the eyes of the user, when said protective device is worn by the latter.

Preferably, the sheet is made of polyvinyl chloride.

According to an alternative embodiment, the protective device comprises two second straps each coming from one of the ends of the lower edge or from one of the lateral edges of said strip.

The sheet is advantageously cut out in a single operation to define the strip and the two first straps or to define the strip and the two first straps and the two second straps.

Preferably, the sheet includes additional globally round cutouts at the most mechanically weak and/or the most stressed zones.

BRIEF DESCRIPTION OF THE DRAWINGS

Other advantages and features will be clearer from the following description of an embodiment of the invention in reference to the appended drawings in which:

FIG. 1 is a perspective view of a protective device according to the invention worn by an individual, FIG. 2 is a top view of the cutting out of the protective device of FIG. 1 while flat, FIG. 3 is a top view of the cutting out of an alternative embodiment of the protective device according to the invention while flat, FIG. 4 is a perspective view of a second alternative of the protective device according to the invention worn by an individual, FIG. 5 is a top view of the cutting out of a third alternative embodiment of the protective device according to the invention while flat.

DESCRIPTION OF THE EMBODIMENTS

FIGS. 1 and 2 show a device 1 for protecting the respiratory tract and at least one part of the face of a user against projections. Said protective device 1 comprises a single sheet 2 defining a strip 3 having the overall shape of a rectangle or a square and at least two first straps 4A, 4B each coming from one of the ends of the upper edge 31 of said strip 3.

Here, upper or lower designates elements or parts of elements of the protective device, according to the invention, located respectively at the top or bottom of said device, when it is worn normally by the user.

It goes without saying that the strip 3 could have a shape completely different than rectangular or square, without going beyond the present invention.

With this configuration, during normal use of the protective device 1, the strip 3 of the sheet 2 is shaped to cover at least the nose and the mouth of the user, the upper edge 31 of said strip 3 resting on the top of the nose, and the two first straps 4A, 4B are arranged to be tied together at the back of the head of the user while passing above the ears of the latter.

However, in this configuration, it is indeed understood that the lower edge 32 of the strip 3 is free and thus that the lower part of the protective device 1 is open, which provides better breathing to the user than with the known surgical masks, which tend to oppress said user by hindering their breathing.

The sheet 2 is flexible and made of a material impermeable to projections, such as, for example, contaminating projections coming from the sick, said material advantageously being synthetic such as, preferably, polyvinyl chloride (PVC). Indeed, PVC has the following numerous advantages:

- PVC is a material that is easily washable, disinfectable and thus reusable,
- PVC is a 100% recyclable monomaterial, without phthalate and compliant with the European Reach Directives, this material already being used to create numerous products intended to be in contact with the skin of a user such as, for example, bank card cases or pharmacy prescription holders,
- PVC is a material resistant to tearing, which has, however, a certain elasticity when it is used as a flexible sheet having a small thickness, of approximately 0.25 to 0.75 mm, which is of interest for the retention of the protective device 1 using the two first straps 4A, 4B and for its adaptation to the shape of the face of the user regardless of its morphology, thus guaranteeing a comfort of use and effective protection while conferring on the bottom part of the strip 3 a certain rigidity allowing the protective device 1 to ensure its role of protective shield that can also protect the neck of the user, and finally, PVC is a routinely used material and thus not very costly.

It is thus indeed understood that the use of PVC allows to overcome the main disadvantages of the known surgical masks made of paper or fabric, namely: the permeability, the single use, the lack of comfort and the non-recycling.

In reference to FIG. 2, the sheet 2 is cut out in a single operation to define the strip 3 and the two first straps 4A, 4B in the shape of an L. This operating mode, which does not require any addition of material, any welding or gluing between two elements or parts of elements, is particularly simple and fast, and thus not very costly.

To avoid any risk of untimely tearing at the mechanically weakest and/or the most stressed zones such as, in particular, the sharp angles between the strip 3 and the two first straps 4A, 4B, advantageously additional globally round cutouts 21 are made in the sheet 2 at said zones. For the same reasons, curves can also be provided, not shown in all the sharp angles.

According to an alternative embodiment, the protective device 1' is similar to the protective device 1 described above and includes a flexible sheet 2' impermeable to projections, the cutting out of which while flat is shown in FIG. 3, and defining a strip 3' having the overall shape of a rectangle or a square and two first straps 4A', 4B' each coming from one of the ends of the upper edge 31' of said strip 3'. However, the protective device 1' further includes two second straps 5A', 5B' each coming from one of the ends of the lower edge 32' of said strip 3'.

With this configuration, during normal use of the protective device 1', the strip 3' of the sheet 2' is shaped to cover at least the nose and the mouth of the user, the upper edge 31' of said strip 3' resting on the top of the nose, the two first straps 4A', 4B' are arranged to be tied together at the back of the head of the user while passing above the ears of the latter, and the two second straps 5A', 5B' are arranged to be tied together at the back of the neck of said user.

However, with this configuration of the protective device 1', it is understood that the two second straps 5A', 5B' can also be tied together under the chin of the user. The tying under the chin of said two second straps 5A', 5B' allows to better apply said protective device 1' onto the face of said user and to limit the entries of projections in particular at the top of the protective device 1' and the cheeks of the user.

Likewise, to avoid any risk of untimely tearing at the mechanically weakest and/or the most stressed zones such as, in particular, the sharp angles between the strip 3' and the two first straps 4A', 4B' and second straps 5A', 5B', advantageously additional globally round cutouts 21' are made in the sheet 2' at said zones. For the same reasons, curves can also be provided, not shown in all the corners.

To avoid any risk of untimely tearing at the mechanically weakest and/or the most stressed zones, the additional cutouts 21, 21' can be replaced by weld points. However, this configuration requires adding an operation to the manufacturing of the protective device 1, 1' and consequently increases its unit cost.

A person skilled in the art will have no difficulty in dimensioning the sheet 2, 2' to adapt the protective device 1, 1' to the various morphologies of adults or children.

According to a second alternative embodiment shown in FIG. 4, the protective device 11 is similar to the protective device 1 described above and includes a flexible sheet 12 impermeable to projections defining a strip 13 having the overall shape of a rectangle or a square and two first straps 14 each coming from one of the ends of the upper edge 131 of said strip 13.

However, during normal use, the protective device 11 differs from the protective device 1 in that the strip 13 of the sheet 12 is shaped to cover at least the nose and the mouth of the user and a large part of the face of the latter, the upper edge 131 of said strip 13 thus resting on the forehead of the user, and the two first straps 14 are arranged to be tied together at the back of the head of said user while passing above the ears of the latter.

It is indeed understood that with this configuration which also covers the eyes of the user, the strip 13 of the protective device 11 is shaped to be transparent at least in front of the eyes of the user, when said protective device 11 is worn by the latter. For reasons of ease of manufacturing, the sheet 12 is made of a transparent material such as, preferably, polyvinyl chloride for the same reasons described above, the strip 13 of the protective device 11 thus being entirely transparent.

Like the above protective devices 1, 1', the sheet 12 is cut out in a single operation to define the strip 13 and the two first straps 14 in the shape, for example, of an L. This operating mode, which does not require any addition of material, any welding or gluing between two elements or parts of elements, is particularly simple and fast, and thus not very costly.

To avoid any risk of untimely tearing at the mechanically weakest and/or the most stressed zones such as, in particular, the sharp angles between the strip 13 and the two first straps 14, advantageously additional globally round cutouts are made in the sheet 12 at said zones. For the same reasons, curves can also be provided, not shown in all the sharp angles.

According to a third alternative embodiment, the protective device 11' is similar to the protective device 11 described above and includes a flexible sheet 12' impermeable to projections, the cutting out of which while flat is shown in FIG. 5, and defining a strip 13' having the overall shape of a partly transparent rectangle or square and two first straps 14A', 14B' each coming from one of the ends of the upper edge 131' of said strip 13'. However, the protective device 11' further includes two second straps 15A', 15B' each coming from one of the lateral edges of the strip 13', said lateral edges connecting to each other the lower 132' and upper 131' edges of said strip 13'.

Without going beyond the context of the present invention, the two second straps 15A', 15B' can also each come from one of the ends of the lower edge 132' of said strip 13'.

With this configuration, during normal use of the protective device 11', the strip 13' of the sheet 12' is shaped to cover at least the nose and the mouth of the user and a large part of the face of the latter, the upper edge 131' of said strip 13' resting on the forehead of the user, the two first straps 14A', 14B' are arranged to be tied together at the back of the head of said user while passing above the ears of the latter, and the two second straps 15A', 15B' are arranged to be tied together at the back of the neck of said user.

Likewise, to avoid any risk of untimely tearing at the mechanically weakest and/or the most stressed zones such as, in particular, the sharp angles between the strip 13' and the two first straps 14A', 14B' and second straps 15A', 15B', advantageously additional globally round cutouts 121' are made in the sheet 12' at said zones. For the same reasons, curves can also be provided, not shown in all the corners.

In the configuration with four straps of the protective device 1' or 11', each first strap 4A', 14A', 4B', 14B' can be tied with the second strap 5A', 15A', 5B', 15B' located near the same lateral edge of the strip 3', 13' around one of the ears of the user.

Without going beyond the context of the present invention, the two first straps 4A, 4B, 4A', 4B', 14, 14A', 14B' of the protective device 1, 1', 11, 11' can also each come from one of the lateral edges of the strip 3, 3', 13, 13'.

Moreover, like the protective devices 11, 11', it goes without saying that the protective device 1, 1' can comprise a sheet 2, 2' made of a transparent material, without going beyond the context of the present invention. Finally, it is understood that the configuration of the protective device 1, 1', 11, 11' according to the invention with two or four straps allows to adapt said protective device 1, 1', 11, 11' to the morphology of the face of the user while guaranteeing its perfect placement on said face.

The protective device 1, 1', 11, 11' according to the invention is particularly intended for caregivers against the projections, in particular liquid and/or solid, of the sick, but it can also be used by paramedics, firemen or the forces for maintaining order. Likewise, the protective device 1, 1', 11, 11' can be usefully used by firemen and caregivers as an "overmask" acting as a first protective barrier allowing to block liquid projections (contaminating droplets, blood, etc.) and thus to increase the service life of the filtering masks worn just below.

Finally, it goes without saying that the examples of protective device 1, 1', 11, 11' according to the invention that have just been described are merely specific illustrations, in no case limiting to the invention.

The invention claimed is:

1. A device for protecting the respiratory tract and at least one part of a face of a user against projections, comprising:

a single flexible sheet, made of a material impermeable to said projections, and defining a strip having the overall shape of a rectangle or a square, the single flexible sheet further comprising at least two first straps, each first strap coming from an end of an upper edge, of said strip;

wherein the strip of the sheet is shaped to cover at least a nose and a mouth of the user, with the upper edge of said strip resting on the top of the nose or on a forehead of said user;

wherein the at least two first straps are formed from the single flexible sheet;

wherein the at least two first straps are at least partially defined by cuts provided in the single flexible sheet; and wherein the at least two first straps are arranged to be tied together at a back of a head of the user while passing above ears of the user.

2. The protective device according to claim 1, wherein the sheet is made of a transparent material.

3. The protective device according to claim 1, wherein the strip is shaped to be transparent at least in front of the eyes of the user, when said protective device is worn by the latter.

4. The protective device according to claim 1, wherein the sheet is made of polyvinyl chloride.

5. The protective device according to claim 1, further comprising: two second straps, each second strap coming an end of a lower edge or from a lateral edges of said strip.

6. The protective device according to claim 5, wherein the sheet is cut out in a single operation to define the strip and the at least two first straps or to define the strip and the at least two first straps and the two second straps.

7. The protective device according to claim 6, wherein the sheet includes additional globally round cutouts at zones that are most mechanically weak and/or most stressed.

* * * * *